US005081775A

United States Patent [19]

Veilleux

[11] Patent Number: 5,081,775

[45] Date of Patent: Jan. 21, 1992

[54] PLOW ATTACHING DEVICE AND METHOD

[76] Inventor: Leo Veilleux, 19 Main St., Danbury, Conn. 06810

[21] Appl. No.: 539,716

[22] Filed: Jun. 18, 1990

[51] Int. Cl.[5] ..... E01H 5/06

[52] U.S. Cl. ..... 37/197; 37/231; 37/236; 37/266

[58] Field of Search ..... 37/231, 234, 235, 236, 37/266, 197

[56] References Cited

U.S. PATENT DOCUMENTS

| | | | |
|---|---|---|---|
| 2,091,343 | 8/1937 | Soule et al. | 37/231 |
| 2,775,176 | 12/1956 | Gibson | 37/236 X |
| 3,214,138 | 10/1965 | Jocher et al. | 37/236 X |
| 3,285,625 | 11/1966 | Krueger | 37/231 X |

*Primary Examiner*—David H. Corbin
*Assistant Examiner*—Arlen L. Olsen
*Attorney, Agent, or Firm*—Edward R. Hyde

[57] ABSTRACT

A device for attaching a plow to the front of a vehicle is described. It secures to the plow mechanism and serves to raise it in a balanced manner for convenient attaching to the vehicle.

3 Claims, 3 Drawing Sheets

PLOW ATTACHING DEVICE AND METHOD

BACKGROUND OF THE INVENTION

Field of the Invention

The present invention relates to a method and apparatus to facilitate the attachment of a plow mechanism such as a snow plow to the front end of a vehicle. Snow plows are customarily detachably mounted to the front end of a vehicles so that they can be detached and stored when not in use and then attached to the vehicle for snow removal and plowing when needed. The vehicle customarily has secured to it appropriate brackets to receive corresponding brackets on the snow plow mechanism. Also a lift mechanism such as a hydraulic lift is customarily mounted on the front end of the vehicle in a semi-permanent manner. When it is desired to use the snow plow it is necessary to maneuver and lift the plow mechanism to match the coupling brackets on the vehicle and the plow. This can be a difficult and cumbersom operation especially for one person. It is to this general problem that the present invention is directed.

SUMMARY OF THE INVENTION

The invention contemplates a device that utilizes the hydraulic lift mounted on the vehicle for raising the plow mechanism in a balanced manner so that the mating brackets of the mechanism and those on the vehicle can be easily brought into alignment for attachment of the plow to the vehicle.

It is understood that if the plow mechanism can be raised while it is horizontally balanced, it can be readily and conveniently attached to the vehicle mounting brackets. Accordingly, the invention provides an arm whose length may be manually adjusted which can be mounted to the lift arm of the hydraulic lift mechanism. A chain depends from the outer end of the adjustable arm and is attached to the plow mechanism at two appropriate points equally spaced on opposite sides of the mechanism'centers line and then by operating the lift mechanism, the plow assembly may be raised. If it raises in an unbalanced manner it is lowered and the chain ends are secured at other locations and this process may be repeated until the proper connecting locations for the chain ends are found to raise the plow mechanism in a manner such that it is essentially horizontally balanced. In addition, the adjustable arm is adjusted in length until an appropriate length is found so that when raised, the plow mechanism and vehicle mating brackets are adjacent each other and may be easily brought together.

It is an object of the present invention to provide a method and apparatus to facilitate the connecting of a plow mechanism to the front end of a vehicle.

It is another object of the present invention to provide an apparatus that is adjustable and can be operated to raise a plow mechanism over its center of gravity so that the mechanism is lifted in a balanced horizontal position.

It is a still further object of the present invention to provide a mechanism having an arm of adjustable length and a lifting chain that can be secured to a plow mechanism at different locations so that the plow mechanism can be lifted into place for mounting on the front end of a vehicle.

BRIEF DESCRIPTION OF THE DRAWINGS

The foregoing and still other objects and advantages of the present invention will be more apparent from the following detailed explanation of the preferred embodiments of the invention in connection with the accompanying drawings herein in which.

SPECIFIC EMBODIMENT OF THE INVENTION

Figure 1:
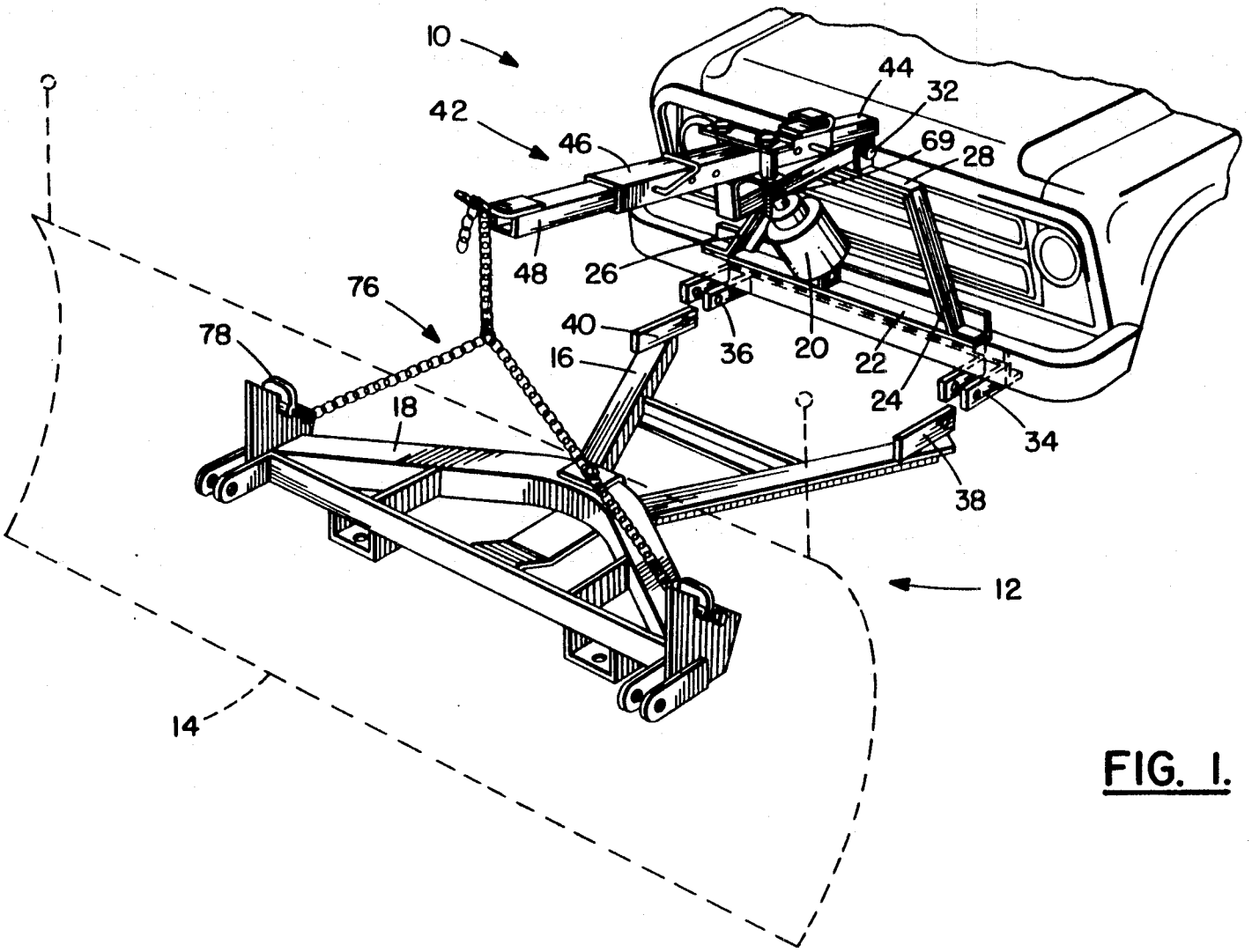
FIG. 1 is a perspective view of a plow mechanism raised by the device of the present invention to a coupling position.

Referring now to the drawings and more particularly to FIG. 1 numeral 10 indicates generally the front end of a vehicle and 12 indicates a snow plow mechanism adapted to be connected to the vehicle. The plow mechanism includes blade 14 A-frame 16 and swivel arm 18. The snow plow mechanism shown is of conventional construction and when it is connected to the vehicle is raised and lowered by an hydraulic lift 20 secured to a bracket 22 which in turn attaches to the vehicle in any convenient manner. Secured to the bracket 22 are upstanding angled arms 24, 26 and an upper arm 28 to which is mounted a lift arm 30 that pivots as at 32 to a bracket on the upper arm 28.

Secured to the underside of the vehicle bumper are a pair of U-brackets 34,36 which receive members 38, 40 secured to the ends of the A-frame 16. When members 38, 40 are in place in the U-brackets 34, 36 pins are inserted through these members to pivotally mount the plow mechanism 12 in position.

When the plow mechanism is in place on the front end of the vehicle, it can be raised and lowered in the conventional manner by the lift mechanism 20. In addition the plow can be turned left and right by hydraulic mechanisms that are not shown in the drawings but are well known in the prior art. In swinging the plow to left and right the swivel arm 18 is turned in one direction or the other.

Figure 2:
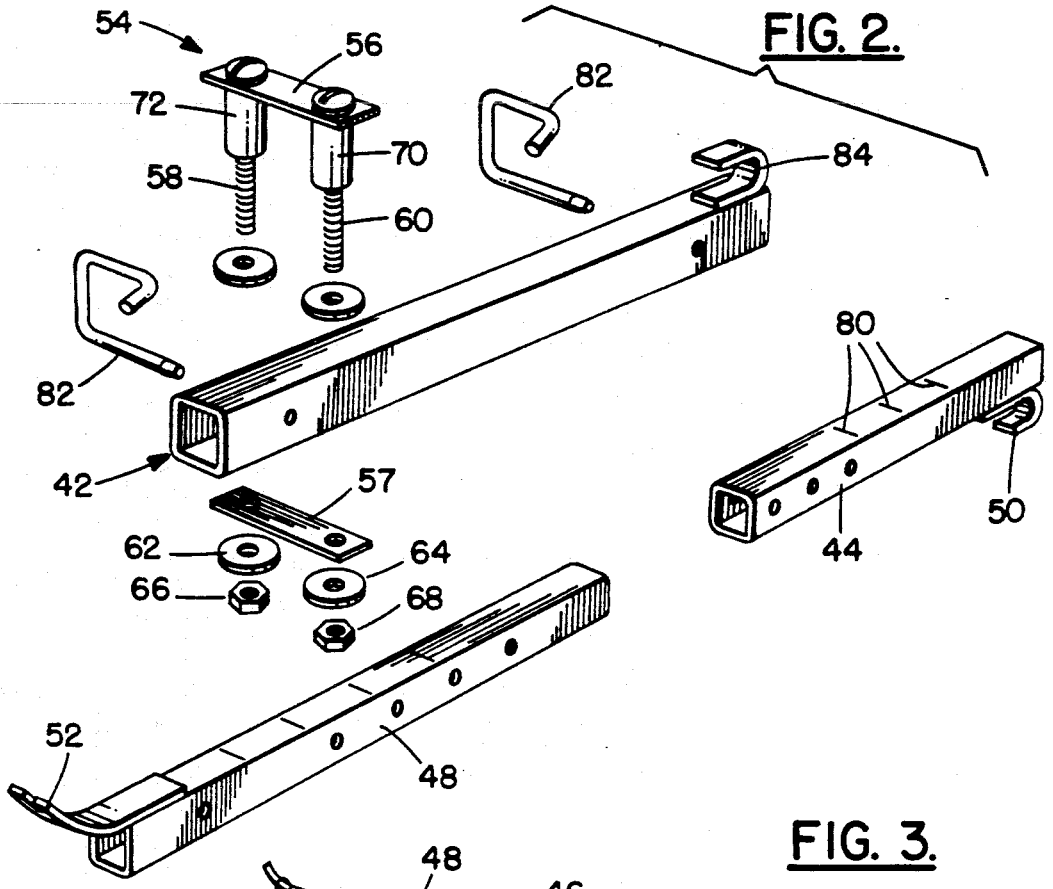
FIG. 2 is an exploded view of the adjustable arm assembly of the present invention.
Figure 3:
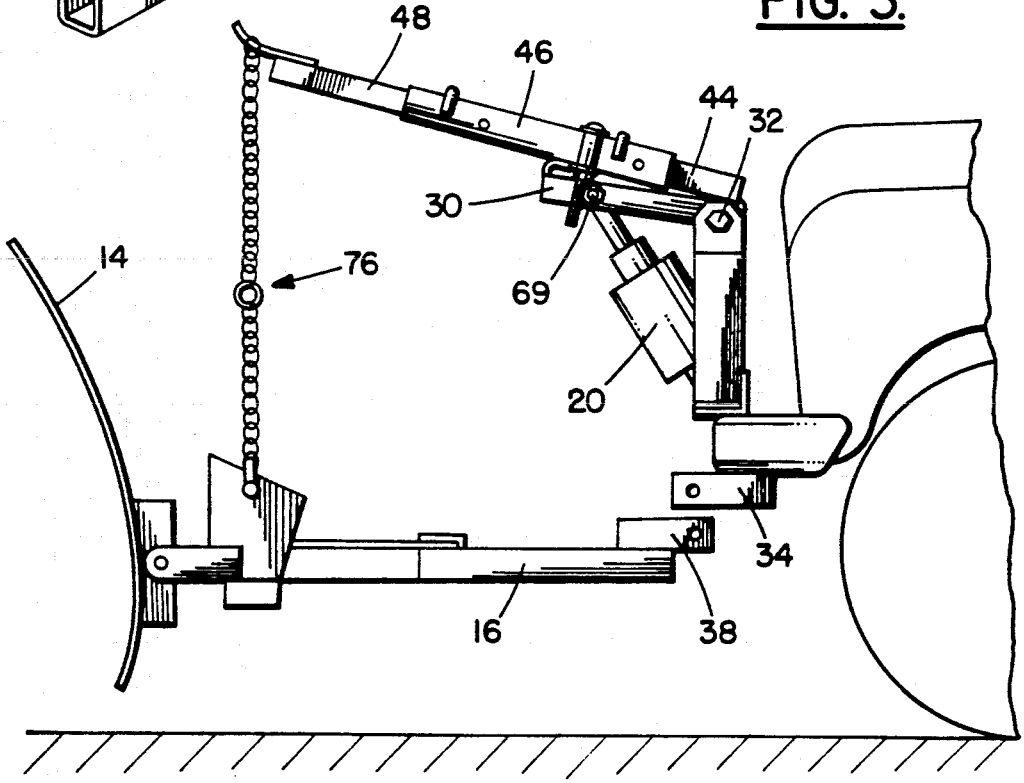
FIG. 3 is a side view of the mechanism of FIG. 1.

It is understood that to raise the heavy and cumbersom plow mechanism to a position in which the brackets 38, 40 mesh with the U-brackets 34, 36 is a difficult task and especially difficult for one man alone to perform. Thus the present invention is provided to facilitate this operation. Accordingly, there is provided an adjustable arm generally indicated as 42 which may be made up of three sections 44, 46 and 48 which telescope together to provide length adjustability. The inner end of section 44 has a hook member 50 secured thereto in any suitable manner as by welding. The hook member is adapted to hook onto the inner end of the hydraulic lift arm 30 for mounting the arm 42 to the lift arm. The sections of the arm 42 may be square channels as shown or of other cross sectional shape. The outer end of section 48 has a notched projection 52 secured thereto as by welding for the purpose of receiving a link chain as hereinafter described. To complete the securing of arm 42 to the lift arm 30 a U-shaped assembly generally indicated at 54 in FIG. 2 is provided consisting of straps 56, 57, machine screws 58, 60, washers 62, 64, nuts 66, 68 and collars 70, 72. It is seen that this U-assembly fits over the adjustable arm 42 with the screws 58, 60 extending down both sides of the hydraulic lift arm 30 to prevent the arm 42 from swinging left or right. The U-assembly also prevents arm 42 from sliding backward because it is just ahead of the bolt 69 that fastens hydro lift 20 to arm 30. Thus with the arm 42 in place on the top of the lift arm 30 by means of hook 50 and the U-assembly 44, it can be raised and lowered by operation of the hydraulic lift mechanism 20. Depending from the outer end of the arm 42 is a link chain 76 the upper section of which is received in the notch of projection 52 and the outer lower ends of which have secured thereto C clamps 78 which are of a known construction. Each clamp has a screw member and lock nut so that the clamp can be hooked at various positions to the steel frame of the plow mechanism 12 and held in place.

The operation of the device of the invention will now be described. When an operator desires to attach the plow mechanism 12 to the front end of a vehicle, he will first place the adjustable arm 42 in position on the top of the lift arm 30. At this time the blade 14 is disposed forwardly perpendicular to the vehicle and the C clamps on the chain 76 are secured to corresponding points on each side of the plow mechanism and the upper end of the chain hooks on the outer end of arm 42. It is desired to lift the plow mechanism in a balanced manner above the mechanism's center of gravity and hence the C clamps are hooked symmetrically to corresponding points on the plow mechanism. The lift mechanism is actuated to lift the plow off the ground. In the event it is not lifted in a balanced manner and held substantially horizontally, the C clamps can be changed to another position either forward or backward on the plow mechanism until a balanced condition is obtained.

In addition to balance, it is necessary that the projections 38, 40 are aligned with the U-brackets on the vehicle. This alignment is accomplished by adjusting the length of arm 42. It is seen that if the arm is extended to a greater length the plow mechanism will be lifted further forward whereas if the arm is telescoped to a shorter length the plow mechanism is lifted further backward toward the vehicle. Adjustability of the arm 42 is conveniently done by sliding the three arms to the appropriate length while the plow mechanism is resting on the ground. The upper surfaces of arm sections 44 and 48 are calibrated as at 80 as shown in FIG. 2 so that when the appropriate length is obtained for the particular plow and vehicle, notation of the calibration can be made so that on subsequent occasions it is not necessary to experiment with different lengths of arm 42. Holes bored in the sections of the arm receive lock pins 82 to hold the arm at a fixed length. In some cases where a shorter arm is needed, section 44 may not be used and 46 and 48 simply telescoped together. In such situations section 46 is inverted so that its hook 84 is downward and engages the inner end of lift arm 30.

Figure 4:
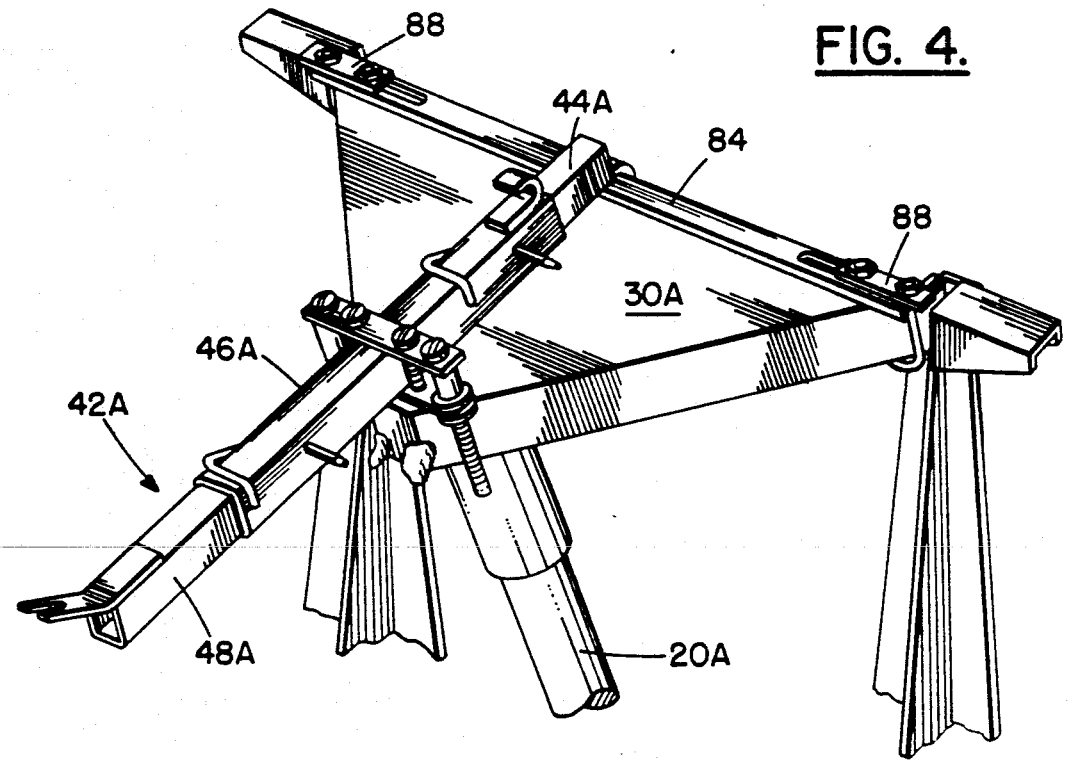
FIG. 4 is a perspective view of the adjustable arm mounted to an alternative plow mechanism.
Figure 5:
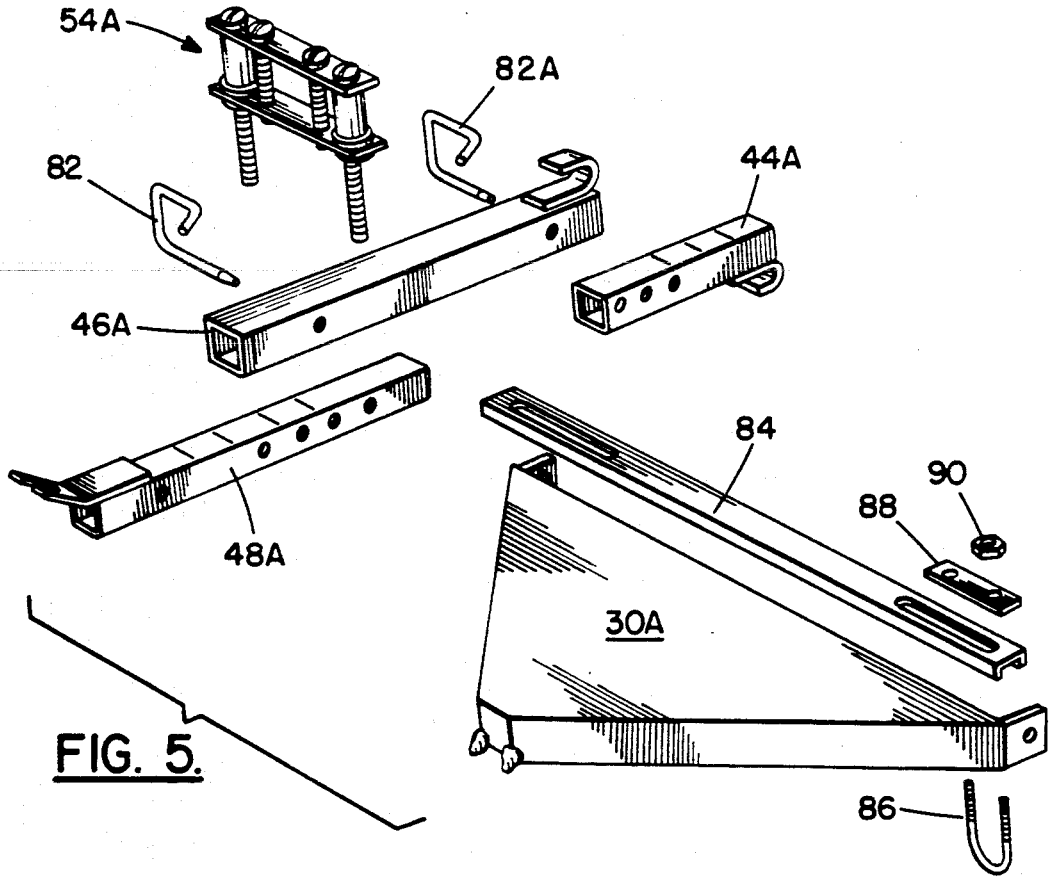
FIG. 5 is an exploded view of the mechanism of FIG. 4.

Another type of lift mechanism is shown in FIGS. 4 and 5 in which the hydraulic lift 20A operates to pivot a lift plate 30A rather than a lift arm as described in FIG. 1. The present invention is adapted to accommodate this type of lift mechanism also. In this modification the arm 42A is similarly made of three sections 44A, 46A and 48A with the other elements of the securing mechanism being to a large extent similar to those described above. However there is provided a slotted support arm 84 adapted to be secured to the upper rearward edge of the lift plate 30A as by threaded U-brackets 86, straps 88 and nuts 90. The purpose of support arm 84 is to provide a solid mounting for the arm 42A. The operation of the modification shown in FIGS. 4 and 5 is substantially the same as that described above.

It is seen that there is provided a mechanism that readily facilitates the coupling of a plow to a vehicle. It should be understood that once the arm 42 is adjusted to the proper length for a particular vehicle and plow, the length is noted as by the calibrations 80. Then on subsequent couplings of the plow, the arm is initially set to the correct length for proper positioning of the plow for coupling upon lifting.

Having thus described the invention with particular reference to the preferred forms thereof, it will be obvious that various changes and modifications may be made therein without departing from the spirit and scope of the invention as defined in the appended claims.

What is claimed is:

1. A device to facilitate coupling to plow assembly to the front end of a vehicle whereby the vehicle and the plow assembly have mating coupling means comprising:

a lift mechanism having an actuator means attached to a first arm; a second arm of three telescoping sections adapted to connect to the lift mechanism and extend forward of the vehicle;

hook means at the inner end of the second arm adapted to engage the lift mechanism;

notched projection means at the outer end of the said second arm;

U-shaped securing means secured around the said second arm and positioned adjacent the attachment of the actuator means and the first arm adapted to engage the lift mechanism to prevent lateral pivoting of the arm;

chain means adapted to connect to the said notched outer projection means and having two depending sections; and clamping means secured to the end of each depending chain section adapted to connect to corresponding locations on the plow assembly whereby the latter may be raised in a balanced manner to facilitate the coupling to the vehicle.

2. A device as set forth in claim 1 in which the telescoping sections of the said second arm means include calibration indicia to facilitate adjusting the proper length thereof to raise the plow assembly in a balanced manner.

3. In a system including a vehicle having a plow hitch including a lift mechanism, plow-connecting brackets and an adjustable forwardly extending arm having depending hook means, the method of connecting a plow assembly to the vehicle hitch comprising the steps of:

locating a point on the plow assembly wherein the plow assembly will be horizontally balanced when raised;

securing the hook means to the balance point on the plow assembly;

adjusting the length of the forwardly extending arm to a length so that the connecting brackets on the vehicle are adjacent to corresponding connecting brackets on the plow assembly;

activating the lift mechanism to raise the plow assembly in a balance, horizontal position; and engaging the respective hitch and plow connecting brackets.

* * * * *